US005724894A

United States Patent [19]

Knorovsky

[11] Patent Number: 5,724,894

[45] Date of Patent: Mar. 10, 1998

[54] CORNER SHELF UNIT

[76] Inventor: Alexander Knorovsky, 4202 Green Ave., Los Alamitos, Calif. 90720

[21] Appl. No.: 671,692

[22] Filed: Jun. 28, 1996

[51] Int. Cl.[6] ..... A47B 23/00

[52] U.S. Cl. ..... 108/42; 108/91

[58] Field of Search ..... 108/42, 91, 93, 108/152; 211/90, 186, 118; 248/235, 318

[56] References Cited

U.S. PATENT DOCUMENTS

| | | | |
|---|---|---|---|
| D. 97,830 | 12/1935 | Armstrong . | |
| D. 188,332 | 7/1960 | Saler . | |
| D. 189,722 | 2/1961 | Wolff . | |
| D. 233,639 | 11/1974 | Wooters . | |
| D. 274,201 | 6/1984 | Aaron . | |
| D. 286,237 | 10/1986 | Muderlak . | |
| D. 329,158 | 9/1992 | Tuzi . | |
| D. 351,751 | 10/1994 | Brightbill et al. . | |
| D. 364,767 | 12/1995 | McLinden . | |
| 2,219,975 | 10/1940 | Bentz | 108/42 X |
| 2,326,864 | 8/1943 | Keeshen . | |
| 2,522,442 | 9/1950 | Garris . | |
| 3,008,585 | 11/1961 | McNeill . | |
| 4,244,301 | 1/1981 | Nakatsu . | |
| 4,523,526 | 6/1985 | O'Neill | 211/118 X |
| 4,573,590 | 3/1986 | Ellis | 211/118 X |
| 4,760,800 | 8/1988 | Hanson | 108/42 X |
| 4,961,506 | 10/1990 | Lang | 108/91 X |
| 5,233,930 | 8/1993 | Wang | 108/42 |

FOREIGN PATENT DOCUMENTS

| | | | |
|---|---|---|---|
| 187334 | 10/1922 | United Kingdom | 108/42 |

*Primary Examiner*—Jose V. Chen

*Attorney, Agent, or Firm*—Gene Scott - Patent Law & Venture Group

[57] ABSTRACT

A shelving unit particularly useful in the bath is perferably adapted for fitting in a corner of the wall such as above a bath tub or adjacent to a shower head. The unit has a first shelf mounted directly to the wall. A second, third, etc., shelves are mounted below the first and hang from it by a pair of side straps. The straps engage the first shelf in a manner that is semi-permanent so that the unit, once mounted, provides rugged duty and is able to hold items such as soap bars on each of the shelves. The shelves are adapted to drain water toward its front edge and to bias a soap bar away from it.

4 Claims, 3 Drawing Sheets

CORNER SHELF UNIT

FIELD OF THE INVENTION

This invention relates generally to shelf assemblies, and more particularly to a shelf assembly adapted for mounting in a corner such as in the bath or shower.

DESCRIPTION OF RELATED ART

Invention and use of devices in the field of the invention is known to the public, as they are used for the intended purposes as defined herein. The following art defines the state of this field at this time:

Saler, U.S. Des. Pat. No. 188,332 describes a design for a corner shelf using an open wire construction.

Wolff, U.S. Des. Pat. No. 189,722, describes a whatnot stand for a corner providing vertical straps, horizontal shelves, and ornamental side supports.

Aaron, U.S. Des. Pat. No. 274,201, describes a design for a bath accessory providing a pair of shelves connected by vertical straps.

Tuzi, U.S. Des. Pat. No. 329,158, describes a design for a bathroom corner shelf unit of one piece molded construction.

Brightbill, U.S. Des. Pat. No. 351,751, describes a design for a wire construction shower caddy for corner mounting.

Garris, U.S. Pat. No. 2,522,442, describes a demountable corner shelf unit having tongue in groove construction.

Nakatsu, U.S. Pat. No. 4,244,301, describes a pre-assembled array of corner shelves which are fastened together by three flexible lines threaded through apertures in the shelves so that they can hand downwardly from a single hook mounted in the corner between two intersecting walls. The lines are so disposed to form an acute angle with the corner line toward the frontmost edge of the shelf disposed in the corner, thereby to force the shelf against the corner and adjacent walls by its own weight and that of objects on it to support the structure and prevent it from slipping or sliding. The spacing may be rearranged simply by moving the lines and the shelves may be readily leveled in the same manner. The shelf array is simply removed for cleaning walls or the shelves without loosening any mounting hardware.

Keeshen, U.S. Pat. No. 2,326,864, describes an adjustable shelf unit providing horizontal free-form shelves interconnected by vertical straps. The assembly intended to be screwed together.

Armstrong, U.S. Des. Pat. No. 97,830, describes a design for a corner shelf.

Wooters, U.S. Des. Pat. No. 233,639, describes design for an accessories holder for a shower.

McNeill, U.S. Pat. No. 3,008,585, describes a whatnot support shelf unit having adjustable shelf spacing wherein the shelves are cantilevered from a pair of vertical straps mountable to a wall.

McLinden, U.S. Des. Pat. No. 364,767, describes a design for a corner mounted shower caddy of one-piece construction.

Muderlak, U.S. Des. Pat. No. 286,237, describes a combined accessory holder and grab bar unit for a tub and shower.

It is shown in the prior art that a shelf unit may be constructed for a corner of a shower wail. However, the prior art does not teach that specific construction of the present invention and particularly the method of mounting. The present invention provides further related advantages as described in the following summary.

SUMMARY OF THE INVENTION

The present invention teaches certain benefits in construction and use which give rise to the objectives described below.

The present invention is a shelving unit particularly useful in a bath and is perferably adapted for fitting in a corner of the wail such as above a bath tub or adjacent to a shower head. The unit has a first shelf mounted directly to the wall. A second, third, etc., shelves are mounted below the first and hang from it by a pair of side straps. The straps engage the first shelf in a manner that is semi-permanent so that the unit, once mounted, provides rugged duty and is able to hold items such as soap bars on each of the shelves. The shelves are adapted to drain water toward their front edge and to bias a soap bar away from it. With this construction in mind, it is an object of the present invention to provide a convenient shelf unit for the bath which is easily mounted in a corner of a wall.

Another object is to provide a means for mounting a first shelf, and then suspending one or more further shelves from the first. In this way, the self capacity desired at the outset may be selected, i.e., one shelf, two shelves, three or more shelves, and the capacity may be changed as shelf space or wall space needs change. It is a further object of the invention to provide a novel means for locking the shelf assembly to the first shelf.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention, a device for holding soap bars and other bath needs on a bathroom wall. In such drawings.

DETAILED DESCRIPTION OF THE PREFERRED EMBODIMENT

Figure 1:
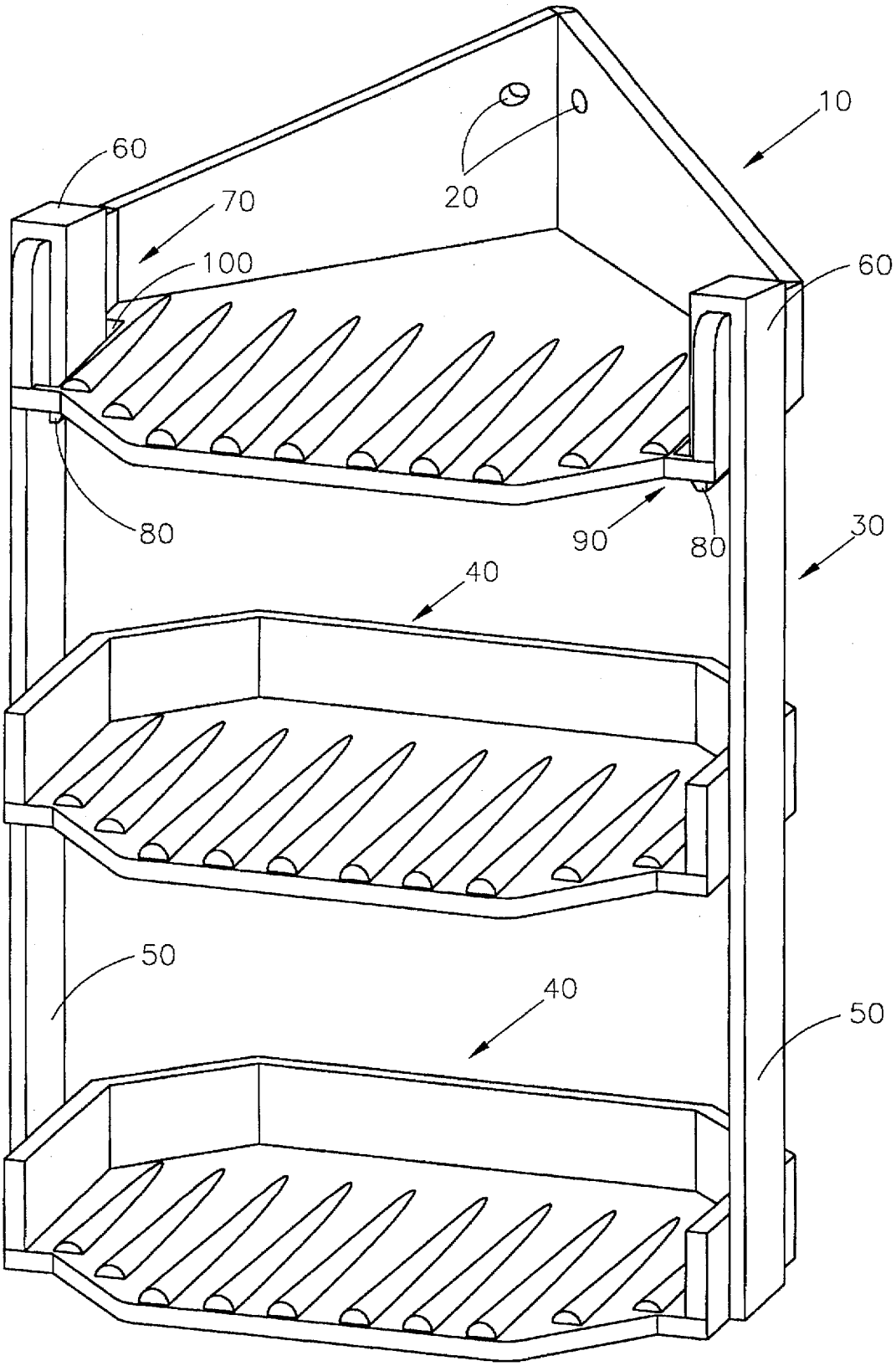
FIG. 1 is a perspective view of the present invention.
Figure 2:
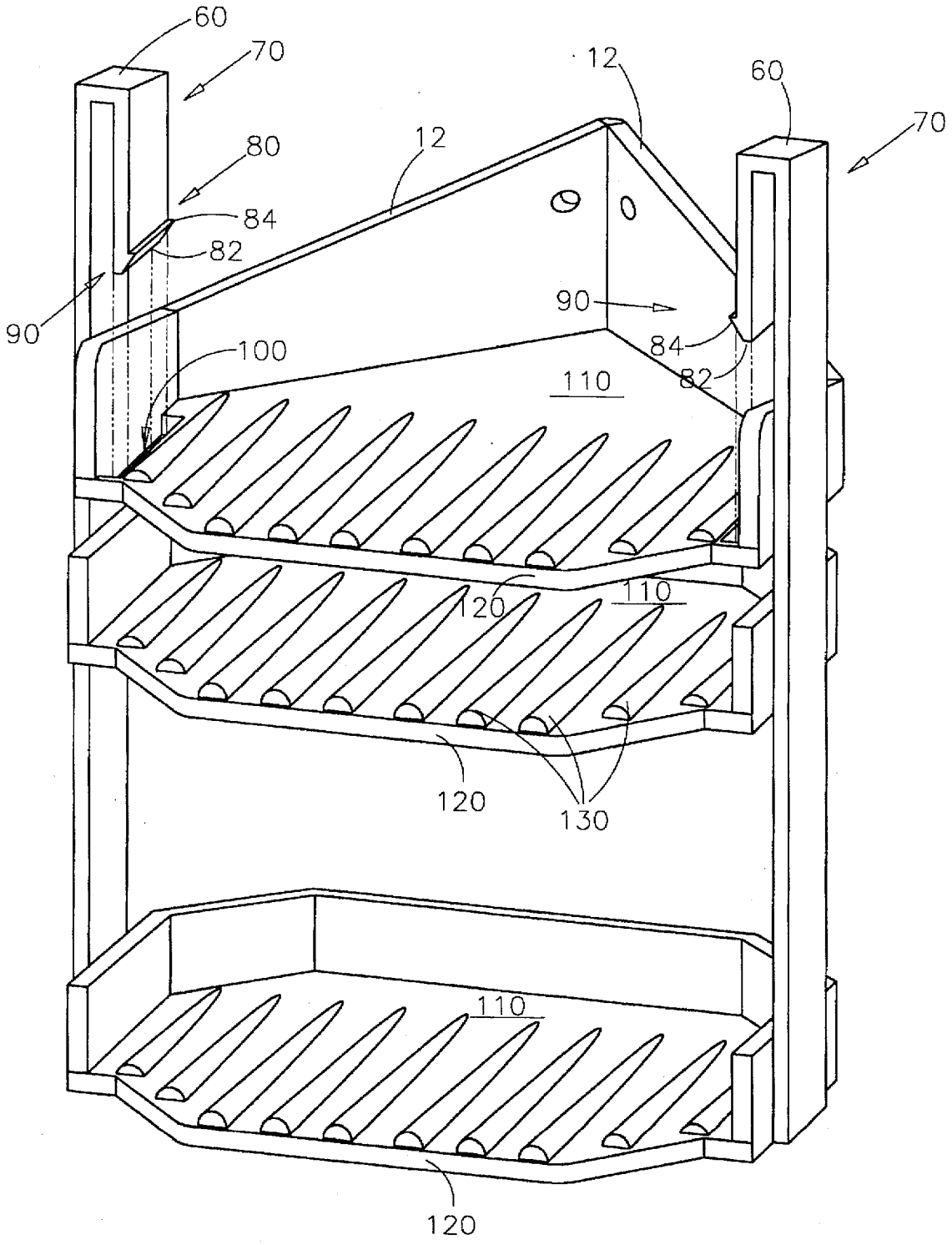
FIG. 2 is a perspective view of the present invention showing the means for assembly of the shelf assembly of the invention to the first shelf of the invention.
Figure 3:
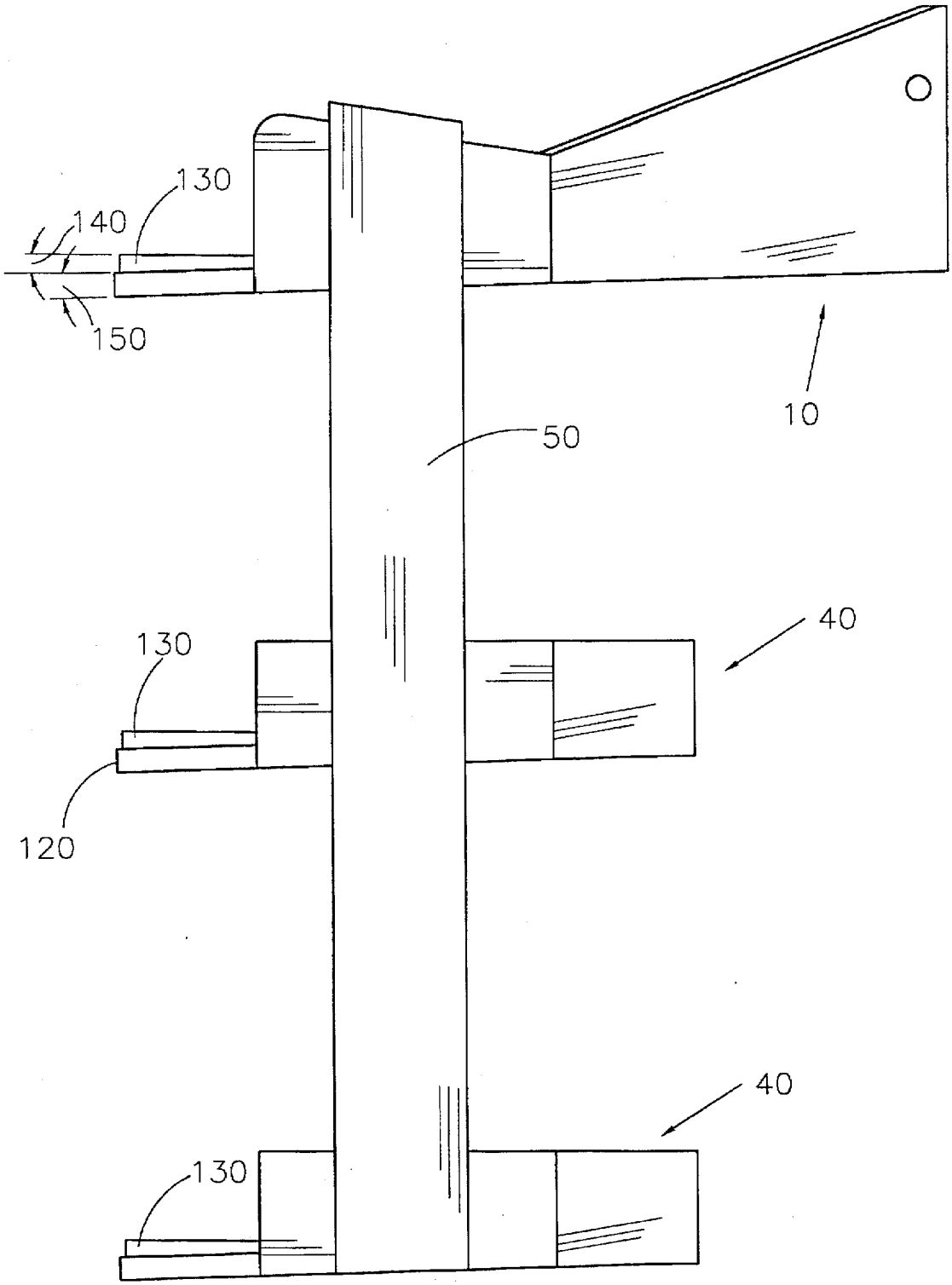
FIG. 3 is a side elevational view of the assembled device.

The above described drawing figures illustrate the invention, a shelf device. The device includes a first horizontal shelf 10 providing, a means for mounting 20 the horizontal shelf 10 on a supporting wall (not shown). As shown in FIGS. 1 and 2, such a mounting means might typically be a pair of mounting holes for accommodating a pair of fasteners such as screws (not shown). The device further includes a shelf assembly 30, comprising at least one further horizontal shelf 40, and, as shown in the figures, two or more such shelves. The shelf assembly, has, preferably formed integrally with it, a pair of laterally positioned, opposing, vertically oriented, means for suspension 50. Both of the suspension means 50 providing a means for engagement 60 with the first shelf 10. The suspension means 50 and the engagement means 60 are positioned and adapted such that the shelf assembly 30 is suspended by the suspension means 50 in a position below the first shelf 10.

Preferably, the pair of suspension means 50 are elongate straps positioned on opposing sides of the self assembly, and extend upwardly from it. Each of the engagement means 60 is preferably a U-shaped hanger 70 providing an L-shaped ridge 80 at a terminal end 90 of the U-shaped hanger 70. The L-shaped ridge 80 of each of the engagement means 60 engages one of a pair of laterally spaced apertures 100 in the first shelf 10. Each of the ridges 80 has a shape which allows it to lock with one of the apertures 100. In the preferred embodiment the ridge 80 is shaped so that a narrow end 82 of the ridge 80 enters the aperture 100 first, upon insertion of the ridge 80 into the aperture 100. A wider end 84 of the ridge 80 enters the aperture 100 last and is sized so as to require being forced through the aperture 100 so that the wider end 84 of the ridge 80 locks the ridge under the first shelf 10.

In the preferred embodiment, the first shelf 10 is generally triangular shaped in order to correspond with a typical right angle corner of the supporting wall. In this case the first shelf 10 provides two orthogonally positioned side walls 12 for abutting the wall surfaces of the corner of the supporting wall. The first shelf 10, as well as the other shelve(s) 40 provide an upwardly directed resting surface 110, such that when the side walls 12 of the first shelf 10 are abutting the corner of a vertical supporting wall, the resting surfaces 110 are oriented such that water naturally drains toward a front lip 120 of the resting surfaces 110. The resting surfaces each further include a plurality of upwardly protruding soap rest embossments 130. As shown in the figures, the embossments are shaped to drain water downwardly onto the rest surfaces 110. They are also pitched so as to bias a soap bar to naturally slide away from the front lip 120 of the rest surface 110.

In use, the first shelf 10 is mounted onto a vertical wall of convenience. When this shelf is firmly and securely mounted, the self assembly 30 is hung from the first shelf 10 and engaged with it so that the assembly 30 is securely held in place. The shelves then may be used for storing soap bars and other bath needs (not shown) as required.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A combination shelf device and supporting wall, comprising:

a first, generally triangular shaped, horizontal shelf, providing a means for mounting the horizontal shelf in correspondence with a corner of the supporting wall; and a shelf assembly, comprising at least one further horizontal shelf, and, formed integrally therewith, a pair of laterally positioned, opposing, vertically oriented, means for suspension, each of the suspension means providing a U-shaped means for engagement with the first shelf, the suspension means and the engagement means positioned and adapted such that the shelf assembly is suspended by the suspension means in a position below the first shelf;

wherein the pair of suspension means are elongate straps positioned on opposing sides of the at least one further shelf and extending upwardly therefrom; and wherein each of the engagement means with the first shelf is a U-shaped hanger providing an L-shaped ridge at a terminal end thereof, the terminal end and the L-shaped ridge of each of the engagement means engaging one of a pair of laterally spaced apertures in the first shelf, each of the ridges being of such shape as to lock into one of the apertures.

2. The device of claim 1 wherein each of the engagement means with the first shelf is a U-shaped hanger providing an L-shaped ridge at a terminal end thereof, the terminal end and the L-shaped ridge of each of the engagement means engaging one of a pair of laterally spaced apertures in the first shelf, each of the ridges being of such shape as to lock into one of the apertures.

3. The device of claim 2 wherein the first shelf provides two orthogonally positioned side walls for abutting the corner of the supporting wall, and an upwardly directed resting surface between the side walls, such that with the side walls abutting the corner of the supporting wall, the resting surface is oriented such that water naturally drains toward a front lip of the resting surface.

4. The device of claim 3 wherein the resting surface further includes a plurality of upwardly protruding soap rest embossments, the embossments shaped and oriented so as to bias a soap bar to naturally slide away from the front lip of the rest surface.

* * * * *